US008534954B2

(12) United States Patent
Geary

(10) Patent No.: US 8,534,954 B2
(45) Date of Patent: Sep. 17, 2013

(54) POT HOLE REPAIR PATCH AND METHOD OF INSTALLATION

(75) Inventor: Timothy Geary, Camarillo, CA (US)

(73) Assignee: The Geary Trust, Santa Rosa Valley, CA (US)

( * ) Notice: Subject to any disclaimer, the term of this patent is extended or adjusted under 35 U.S.C. 154(b) by 0 days.

(21) Appl. No.: 13/413,999

(22) Filed: Mar. 7, 2012

(65) Prior Publication Data

US 2013/0149035 A1 Jun. 13, 2013

Related U.S. Application Data

(60) Provisional application No. 61/487,926, filed on May 19, 2011.

(51) Int. Cl.
*E01C 3/06* (2006.01)

(52) U.S. Cl.
USPC ..... 404/31; 404/70

(58) Field of Classification Search
USPC ..... 404/35, 45, 70, 71, 31, 75
See application file for complete search history.

(56) References Cited

U.S. PATENT DOCUMENTS

| | | | | |
|---|---|---|---|---|
| 4,113,401 | A * | 9/1978 | McDonald | 404/75 |
| 4,507,013 | A * | 3/1985 | Martinak | 404/75 |
| 4,684,288 | A * | 8/1987 | Chapa | 404/35 |
| 4,744,693 | A * | 5/1988 | Smith | 404/77 |
| 5,183,353 | A * | 2/1993 | Buckelew | 404/69 |
| 5,464,303 | A * | 11/1995 | Wells | 404/75 |
| 5,660,498 | A * | 8/1997 | Freeman | 404/17 |
| 5,749,674 | A * | 5/1998 | Wilson, Sr. | 404/75 |
| 5,829,914 | A * | 11/1998 | Wells | 404/73 |
| 5,947,634 | A * | 9/1999 | Robillard | 404/70 |
| 7,232,276 | B2 * | 6/2007 | Oka et al. | 404/31 |
| 8,142,102 | B2 * | 3/2012 | Wheatley | 404/31 |
| 2006/0165485 | A1 * | 7/2006 | Lowe | 404/9 |
| 2009/0056261 | A1 * | 3/2009 | Damgaard | 52/408 |
| 2009/0067926 | A1 * | 3/2009 | Greer | 404/69 |

FOREIGN PATENT DOCUMENTS

| | | |
|---|---|---|
| BY | 8020 | 6/2004 |
| RU | 1825836 A1 | 7/1993 |

* cited by examiner

*Primary Examiner* — Gary Hartmann
(74) *Attorney, Agent, or Firm* — Ralph D. Chabot

(57) ABSTRACT

A road patch for repair of potholes is disclosed. A pothole is preliminarily repaired with asphalt fill and compacted per current standard practice. Thereafter, a road patch is placed upon the compacted top surface of the asphalt fill, overlapping onto the adjacent road surface and compressed. The road patch forms a water proof seal over the surface area of the patch preventing water from seeping into the repaired pothole. The patch also resists crack propagation and minimizes the potential of asphalt chipping and the breaking down of the asphalt fill.

10 Claims, 2 Drawing Sheets

POT HOLE REPAIR PATCH AND METHOD OF INSTALLATION

BACKGROUND OF THE INVENTION

This invention relates to pothole repair on roadways and highways.

Potholes are a common occurrence on roadways and develop over time as a result of a weakness in the original roadway installation. This weakness can be the result of an improper compaction of the roadway where, over time and cyclic loading from vehicular traffic, small cracks are created, particularly at joints, after which water can seep into the cracks and propagate the crack further; either by the hydraulic force created by the cyclic loading, or from the water freezing in cold environments.

Potholes are formed by rainwater flowing through cracks in old or weakened asphalt. The water is soaked up by the mixture of rock, gravel, and sand that supports the road. Vehicles passing over the road force water through the soggy roadbed, eventually causing erosion. Asphalt sinks into the eroded portions of the roadbed and eventually causing cracks under the continued impact of vehicle tires. This causes chunks of asphalt to come loose.

After a pothole is formed, the repair typically comprises the placement of a sufficient amount of asphalt to fill the pothole. This asphalt is, at the time of placement, soft and compressible. Following placement, the asphalt is compressed so that it is substantially level with the overall road surface.

Problems can occur frequently with this sort of repair activity. First, the asphalt may not have been sufficiently compressed and allowed to cure properly. Before becoming fully cured, asphalt is very pliable and prone to developing stress cracks, particularly at or near the joint edge located adjacent to the surrounding road surface. This portion of the asphalt fill is susceptible to crack development due to its proximity on one side to a rigid, cured road surface and on the other side to pliable, uncured asphalt. In addition none of the aggregate filler crosses the boundary, leaving an unreinforced zone at the joint. Slight cracks developed soon after application can propagate as a result of water intrusion, and freezing. The interface between asphalt fill perimeter and existing road surface can develop pathways for rainwater to collect below the pothole repair surface causing erosion.

Over time, the asphalt fill will cure. However, because of real world situations, the fill does not have the necessary time to cure completely before being subjected to weathering and repetitive load conditions resulting from vehicular traffic. This often times results in the same locations being repaired over and over. Thus, a problem with present methods for repairing potholes is that the repair oftentimes is only a temporary fix, and, over time, the repetitive repair results in increasingly high repetitive costs.

Expenditures caused by potholes are not limited to the cost of road repair. It has also been reported that the damage to cars have cost insurance companies approximately five billion dollars in 2010 alone.

SUMMARY OF THE INVENTION

While considering the failure of others to make use of all of the material in this technology, the inventor has realized that providing a patch to cover a repaired portion of a roadway could provide substantial improvement in the longevity of the repaired portion. My patch provides an environment allowing the asphalt filler (hot or cold) to resist crack propagation while curing and results in a more durable and longer service life.

The invention is a patch comprising a wear layer having a top surface and a bottom surface, the top surface is made of a material for frictional contact with the tires of oncoming traffic to provide traction similar to the surrounding roadway surface. Preferably, the top surface consists essentially of aggregate stone frit. A bottom sealing layer is provided to not only form a seal or barrier with the surrounding adjacent road surface to prevent water migration into the pot hole repair but also to secure the patch in position. Disposed in-between the wear layer and the bottom sealing layer is a structural reinforcement layer to prevent the patch from tearing apart. On the backside of the sealing layer is a disposable film backing.

Once asphalt fill has been placed to repair a pothole, my patch is positioned across the top surface of the fill overlapping upon a portion of the surrounding existing road surface. My product is designed to have a similar friction engaging top surface as that of the surrounding roadway as well as to form a structural reinforced barrier resistant to cracking. Properly installed, my patch forms a barrier with the adjacent surrounding road surface preventing water seepage which generally accelerates breakdown of the asphalt fill.

The patch must be appropriately sized to cover the surface area of the repaired pothole and have sufficient contact with the surrounding street surface to create a water proof seal. An oversized patch is not detrimental. The patch must also be durable to withstand cyclic compressive loads of oncoming vehicles and weathering.

As discussed earlier, the top surface is designed for frictional contact with vehicular tires having a similar frictional characteristic to the surrounding roadway surface. In a preferred embodiment, the top surface is a composite comprised of an exposed stone frit embedded in a viscous bitumen matrix which optionally may contain fibers, this is similar in appearance to the surface of roof shingles. This frictional top surface is laminated directly to the structural reinforcement layer. Preferably, the top surface is designed to color blend with the cosmetic appearance of the existing street surface.

The structural reinforcement layer is a composite comprised of a viscous bitumen reinforced with: a) fibrous material thus forming a composite; b) a mesh screen encapsulated within the bitumen; or, c) a combination of a) and b). Reinforcement of the viscous bitumen with a mesh screen and/or fibrous materials not only resists crack development and provides strength and continuity but also functions as an additional moisture seal. Reinforcement thus resists shearing or tearing forces which may occur as a result of a vehicular tire at rest turning to a different direction.

Thus, the frictional top surface can be referred to as a "fritted layer" which in one embodiment is sealed to a viscous bitumen embedded fiber layer that can be defined as "fiber ladened" viscous bitumen layer.

The reinforcing materials which comprise a portion of the structural reinforcement layer strengthen the overall patch so that it is capable of being subjected to repetitive high load conditions and maintain structural integrity necessary to restrain crack propagation and maintain a continuous seal over the patch covered area.

Fibers and filaments which are suitable for reinforcement include substances having a high modulus of elasticity and are capable of being subjected to repetitive high load conditions and maintain structural integrity necessary to restrain crack propagation. Examples of such fibrous material include those made from: a) natural vegetable fibers such as abaca, bamboo, coir, cotton, flax/linen, hemp, jute, kapok, kenaf, pina raffia, ramie, sisal and wood; b) mineral fibers such as E-glass S-glass, continuous basalt fiber, carbon graphite, metallic and steel wool; c) man-made cellulose fibers such as acetate, bagasse, bamboo, triacetaste, artsilk, rayon, seasell and viscose; and d) polymers such as acrylic, aramid (twaron, Kevlar, technora, Nomex), melamine, microfiber, modacylic, nylon, olefin, polyester, polyamide, polyamid, polyethylene, vinylon and zylon; and e) combinations thereof.

As discussed earlier, the bottom sealing layer is a sealant for easily adhering the road patch to the street and asphalt fill surfaces to prevent subsequent slipping of the patch and exposure of the asphalt fill. Preferably, the sealing layer is a non-fibered laden layer of viscous bitumen or modified viscous bitumen. Other substances could also be used in special conditions. What is most important for the sealant layer is that the composition provides suitable adhesion for attachment of the patch to the road surface so the patch will not slide off from covering the top of the asphalt fill. Also, the thickness or volume of the sealant layer must be sufficient to provide a seal with the surrounding road surface after a compression step for preventing water migration into the asphalt fill.

Thus, the invention accomplishes three functions. First, the top surface is designed for wear resistance, i.e., periodic contact with the tires of oncoming vehicular traffic. Second, the structural reinforcement layer is for providing strength and longevity to the overall patch. Third, the bottom sealant layer, is preferably a non-fibered viscous bitumen, for adhesion to the roadway and minor expansion past the edges of the patch. Additionally, through roadway wear i.e. cyclic tire compression of the patch causes the layered strata of the patch to compress adding much greater strength and adds to the ultimate goal of compaction into the repaired roadway asphalt and/or concrete for permanent sealing of the repair.

The road patch can be manufactured in various sizes and shapes. The proper size for a particular application is where the patch will have a slightly larger perimeter than the pothole itself. For larger potholes where a single patch is not of a sufficient size, multiple patches can be applied by overlapping the edges of the patches. What is most important is that the patch surface area be sufficiently large to not only cover the pothole repair surface area but to also sufficiently overlap with the surrounding road surface, and then, following a compressive force applied to the top surface of the patch, the adhesive layer is forced upon the road surface to create a water proof seal. The overlap also provides a structural tie to the adjacent roadbed to minimize or even eliminate propagation of cracks in the asphalt fill and contain fragments of the repair.

The patch is sufficiently thin so that following proper installation, the vertical height of the patch, relative to the surrounding road surface, will be minimal. The vertical height of the patch above the adjacent road surface will not cause damage to a vehicle's suspension or become a nuisance to vehicular travelers.

Application and compaction of the asphalt fill is performed according to standard operating procedure well known in prior art. The top surface of the asphalt fill will be the same or slightly higher than the surrounding road surface after compaction. Following this compaction procedure, the non stick disposable film backing is removed and the road patch is placed upon the asphalt fill so that the sealing layer surface of the patch is in contact not only with the top surface of the asphalt fill, but also with the surrounding road surface. Preferably, the overlap of the patch to the surrounding road surface is at least 2 inches. After the patch is placed, a second compaction occurs over the entire patch surface to ensure complete contact and adhesion between the patch, the asphalt fill and the adjacent road surface.

Over time, the patch and the asphalt fill below completely cure and are bonded to one another. The structural reinforcement layer, particularly the mesh screen and/or fibrous filaments, provide a layer which resists cracking, water intrusion, asphalt fracturing, and retains asphalt fragments.

For wet weather environments, an optional design feature comprises a plurality of holes extending through the entire laminate of the patch; preferably leaving visible holes on 1" to 2" centers. These holes will allow air and any moisture present to vent during installation and achieve full surface contact and adhesion. Use of patches with the aforementioned holes will prevent undesired entrapment of bubbles under the patch surface. The viscous bitumen used therefore must be sufficiently fluid to, over time, close off the holes as a result of subsequent cyclic loads from vehicular traffic. The pierced holes should then easily close with the adjacent viscous bitumen slowly filling the space after a sufficient number of cyclic loads from traffic or during the installation rolling procedure. It is believed that if air and water have a pathway to escape from the pothole while the asphalt fill is new, the sealing and protection will be more effective and consistent.

As mentioned earlier, the patches can be made in a variety of sizes and shapes. By way of example, the patches can also be in the form of a donut ring for placement around the perimeter of manhole covers and other utility covers, typically lifted and patched after repaving. Thus, the patches are not limited to uses strictly related to potholes. Other roadway situations are also suitable for their use; particularly where cracks have already propagated but circumstances do not permit the filling with an asphalt fill as with a pothole.

The advantage of over other methods and products in the repair of potholes is that the cause for creating potholes is addressed rather than simply filling a hole with asphalt filler. By addressing the need to form a substantially effective seal or barrier with the existing street surface adjacent to the pothole to prevent water migration, the life of the repair can be greatly extended when compared to a repair where no moisture seal is present. Sealing the pothole repair will reduce overall maintenance costs over an extended period of time since potholes utilizing the patch will last for an extended period. In addition, this patch provides a structural bond across the fill to the adjacent road surface to limit the opening and propagation of cracks and asphalt edge fragmentation.

As stated earlier, my patch can be manufactured in various shapes and sizes. Because of the materials of construction used, the patches can be stacked and shipped in a multiple unit pile and thereafter easily separated for use. The patch itself has sufficient internal strength to tolerate lifting, turning and flexing without tearing prior to installation and can maintain its general shape during its installation.

An alternative embodiment would comprise a patch having a top wear layer and a structural reinforcement layer as described earlier. However, in addition to having a bottom sealant layer laminated to the structural reinforcement layer, an additional adhesive layer can be provided on-site and separately applied to the top surface of the asphalt fill and adjacent existing road surface in unusual weather or roadway conditions. Thereafter, this patch embodiment could then be positioned and compressed to form the water proof seal as described earlier in nearly all roadway conditions.

It is to be understood that as new chemicals, composites and laminate materials are developed in the future, these are intended to be covered by my invention so long as the product is capable of creating a water seal and the patch itself is resistant to cracks.

DETAILED DESCRIPTION OF THE PREFERRED EMBODIMENT

Figure 1:
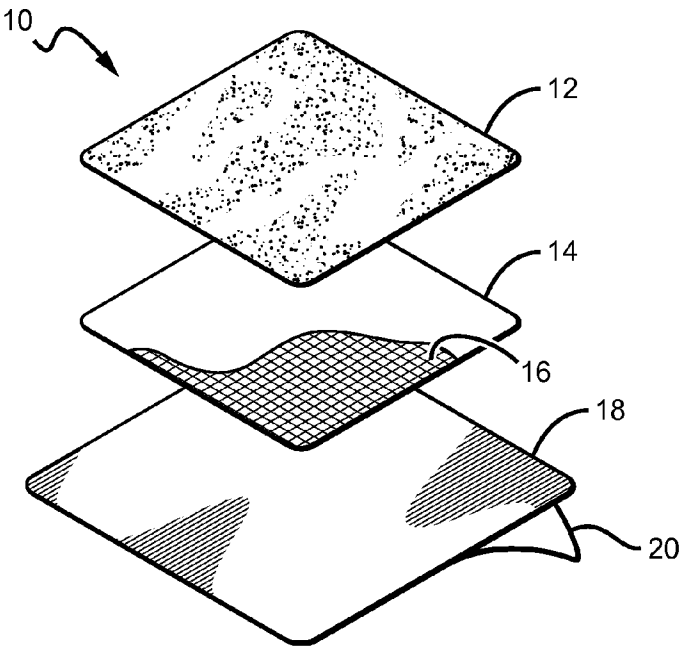
FIG. 1 is an exploded view of the patch made according to my invention.

FIG. 1 illustrates my laminated patch 10 for pothole repair. It is to be understood that the figures presented are not to any scale and are provided for a general understanding of the patch structure and method of use.

As used herein, the term "about" means 10% plus or minus of the stated value.

Patch 10 has a top wear layer 12 comprising a top surface of stone frit filler embedded in a 1/16-1/8 inch thick modified asphalt which could be also reinforced with fiber. A structural reinforcement layer 14 is comprised of viscous bitumen blended with oriented fibrous material and further having encapsulated oriented fibers 16 with an overall layer thickness of about 1/16 inch. A bottom sealant layer 18 comprises about 1/8 inch thick bitumen. A peel-off non-stick film backing 20 is affixed to the lower surface of sealant layer 18 and which is removed prior to application.

Figure 2:
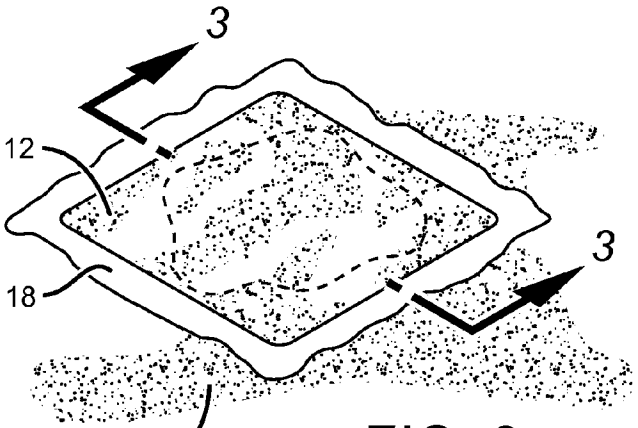
FIG. 2 is a view of how my patch would be applied upon a street.

FIG. 2 illustrates the position of patch 10 on a road surface S once installation is complete.

Figure 3:
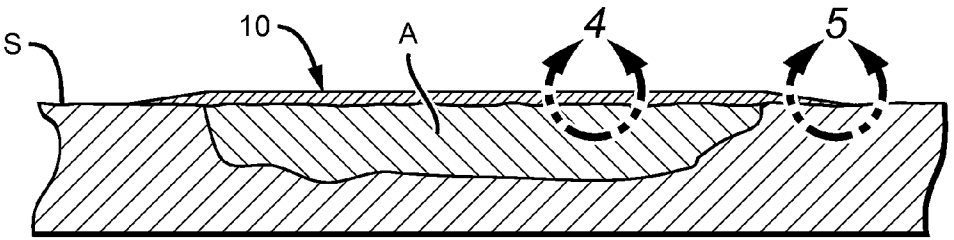
FIG. 3 is a view taken along line 3-3 of FIG. 2.
Figure 4:
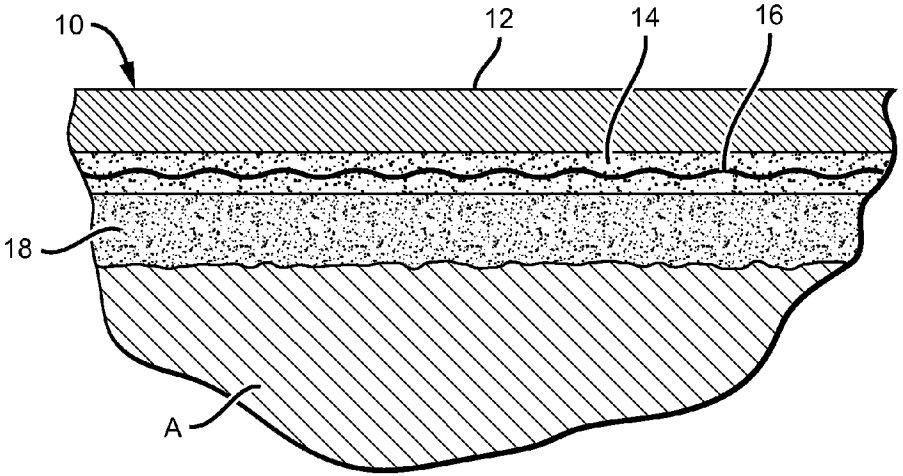
FIG. 4 is a view taken along line 4 of FIG. 3.
Figure 5:
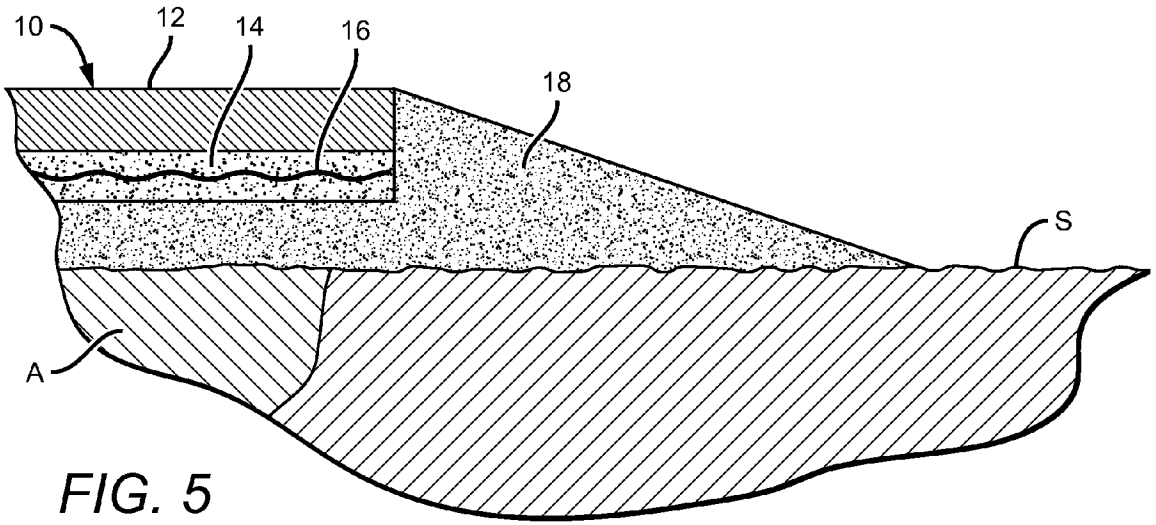
FIG. 5 is a view taken along line 5 of FIG. 3.

FIGS. 3-5 illustrate the relationship of patch 10 relative to road surface S and asphalt fill A following installation.

The method for placement includes first sweeping off edges of the pothole to ensure no loose material or debris are present and then the pothole is filled with either hot or cold asphalt. A sufficient compressive force is applied to compact asphalt fill A using current fill and repair practices which includes removal of any excess fill material An appropriately sized patch 10 is selected for placement upon asphalt fill A which overlaps with the adjacent road surface S surrounding asphalt fill A. Disposable film backing 20 is removed and patch 10 laid upon the surface of asphalt fill A where patch 10 overlaps the adjacent road surface S by at least 2" beyond the repair on all sides. A second compressive force is applied, this time upon patch 10 to compress patch 10 into contact and bond with asphalt fill A and road surface S to prevent water migration. As is best illustrated in FIGS. 4 and 5, following compressions of patch 10, a portions of the viscous bitumen layer 18 is displaced outward into contact with road surface S as well as downward into intimate contact with both surface S and the top surface of asphalt fill A. This contact creates the water proof seal for preventing rainwater from having a pathway to detrimentally breaking down the asphalt fill A.

I claim:

1. A pre-fabricated water-proof patch for roadway surfaces, the pre-fabricated waterproof patch comprising:

a wear layer having a top surface and a bottom surface, said top surface consisting essentially of aggregate stone frit exposed in a bitumen matrix;

a bottom layer comprising a sealant;

a structural reinforcement layer comprised of viscous bitumen in contact with said bottom surface of said wear layer and said sealant layer; said structural reinforcement layer further comprising a reinforcement component selected from the group consisting of: a) fibrous material disposed within said viscous bitumen; b) a mesh screen encapsulated within said viscous bitumen; and, c) a combination of a) and b); and, a plurality of vertical holes extending from said top surface through said bottom layer.

2. The patch of claim 1 further comprising a disposable peel off film backing disposed upon said sealant layer.

3. The patch of claim 1 where the top surface of said wear layer cosmetically color blends with the surrounding road surface.

4. The patch of claim 1 where the sealant of said bottom layer is of sufficient tackiness and volume to provide a water proof seal when applied and compressed upon the surface of an existing roadway.

5. The patch of claim 4 where said sealant is a viscous bitumen.

6. The patch of claim 1 where said wear layer has a thickness of between about 1/16 to 3/16 inch.

7. A pre-fabricated patch to cover a repaired pothole and a portion of the adjacent roadway surface comprising:

a wear layer having a top surface and a bottom surface, said top surface consisting of a material providing a comparable level of traction to vehicular tires as the surrounding road surface;

a reinforcement layer comprised of oriented fibers encapsulated within a pre-determined volume of viscous bitumen, said reinforcement layer in contact with said bottom surface of said wear layer;

a sealant layer disposed below said reinforcement layer and having a sufficient thickness so that a water proof barrier will be formed with the surrounding adjacent road surface in response to a sufficient compressive force being applied; and, a plurality of vertical holes extending from said top surface through said bottom layer.

8. The patch of claim 7 where said top surface material is aggregate stone frit.

9. The patch of claim 8 further comprising a disposable peel off film backing disposed upon said sealant layer.

10. A method for repairing a pothole on a road comprising the steps of:

providing a sufficient volume of asphalt for filling a pothole;

filling said pothole with said asphalt;

compressing said asphalt so the top surface of said asphalt is substantially the same as the top surface of the surrounding road;

providing a pre-fabricated patch, said pre-fabricated patch comprising: a) a top wear layer having a top surface constructed of a material for providing a comparable level of traction to vehicular tires as the surrounding road surface, and a bottom surface; b) a structural reinforcement layer comprising viscous bitumen and a reinforcement component selected from the group consisting of: i) fibrous material disposed within said viscous bitumen, ii) a mesh screen encapsulated within said viscous bitumen, and, iii) a combination of i) and ii); and, c) a bottom sealant layer; said structural reinforcement layer in contact with said bottom surface of said wear layer, said pre-fabricated patch further comprising a plurality of vertical holes extending from said top surface through said bottom sealant layer, said pre-fabricated patch sufficiently sized to cover the top surface of said compressed asphalt fill and a portion of the surrounding road surface to form a moisture barrier following application of a compressive force;

positioning said pre-fabricated patch upon said compressed asphalt; and, applying a compressive load to said pre-fabricated patch so that a portion of said sealant layer is displaced into contact with the surrounding road.

* * * * *